US005802614A

United States Patent [19]

Melone, Jr.

[11] Patent Number: 5,802,614

[45] Date of Patent: Sep. 8, 1998

[54] UNIVERSAL SPORTS GLOVE

[75] Inventor: Charles P. Melone, Jr., 317 E. 34th St. 3rd Floor, New York, N.Y. 10016

[73] Assignee: Charles P. Melone, Jr., New York, N.Y.

[21] Appl. No.: 916,151

[22] Filed: Aug. 21, 1997

[51] Int. Cl.[6] ..... A41D 19/00

[52] U.S. Cl. ..... 2/161.1; 2/161.4; 602/21

[58] Field of Search ..... 2/161.1, 159, 161.4, 2/162, 170; 602/21, 22

[56] References Cited

U.S. PATENT DOCUMENTS

| | | |
|---|---|---|
| D. 262,070 | 12/1981 | Toms . |
| D. 274,015 | 5/1984 | Golomb . |
| D. 281,373 | 11/1985 | Golomb . |
| D. 336,562 | 6/1993 | Chin . |
| 482,647 | 9/1892 | Obear . |
| 975,734 | 11/1910 | Tebeau . |
| 2,388,330 | 11/1945 | Jungmann . |
| 2,547,388 | 12/1951 | Griffin . |
| 2,567,489 | 9/1951 | Lewis . |
| 2,700,159 | 1/1955 | Van Denburgh . |
| 3,466,039 | 9/1969 | Golomb . |
| 3,504,379 | 4/1970 | Glick . |
| 3,581,312 | 6/1971 | Nickels . |
| 3,815,905 | 6/1974 | Golomb . |
| 3,836,146 | 9/1974 | Golomb . |
| 3,890,649 | 6/1975 | Diggins . |
| 4,047,250 | 9/1977 | Norman . |
| 4,067,063 | 1/1978 | Ettinger . |
| 4,222,122 | 9/1980 | Toms . |
| 4,519,097 | 5/1985 | Chappell, Jr. et al. . |
| 4,525,877 | 7/1985 | Chong . |
| 4,531,241 | 7/1985 | Berger . |
| 4,561,122 | 12/1985 | Stanley et al. . |
| 4,603,439 | 8/1986 | Golomb . |
| 4,843,651 | 7/1989 | Gramza et al. . |
| 4,894,866 | 1/1990 | Walker . |
| 5,014,689 | 5/1991 | Meunchen et al. . |
| 5,070,541 | 12/1991 | Goss . |
| 5,195,188 | 3/1993 | Bourdeau et al. . |
| 5,197,149 | 3/1993 | Overton . |
| 5,214,799 | 6/1993 | Fabry . |
| 5,257,418 | 11/1993 | Jaskiewicz . |
| 5,313,667 | 5/1994 | Levine . |
| 5,329,638 | 7/1994 | Hansen et al. . |
| 5,376,066 | 12/1994 | Phillips et al. . |
| 5,435,007 | 7/1995 | Kalvestran et al. . |
| 5,445,566 | 8/1995 | Hayes . |
| 5,459,883 | 10/1995 | Garceau-Verbeck . |
| 5,513,391 | 5/1996 | Garneau et al. . |
| 5,517,694 | 5/1996 | Fabry . |
| 5,581,809 | 12/1996 | Mah . |
| 5,697,104 | 12/1997 | Welton . |

*Primary Examiner*—C. D. Crowder
*Assistant Examiner*—Shirra L. Jenkins
*Attorney, Agent, or Firm*—Felfe & Lynch

[57] ABSTRACT

A glove which supports and stabilizes the wrist and hand during sports and includes:

an inner glove conforming to the hand, fingers and thumb, an outer glove conforming to the hand, fingers and thumb from the wrist beyond the finger and thumb joints;

a first wrist strap surrounding the wrist Having an opening positioned to accommodate the distal ulna head protrusion; and a second wrist strap attached to the thumb side of the outer glove and extending diagonally across the back of the hand, and then around and encompassing the front and back of the wrist over the first strap.

17 Claims, 5 Drawing Sheets

UNIVERSAL SPORTS GLOVE

UNIVERSAL SPORTS GLOVE

This invention relates to a sports glove with dual wrist straps anatomically contoured to protect the hand and wrist from common injuries caused by predictable detrimental forces incurred during sports. This is accomplished by a glove which approximates and reinforces normal or injured ligaments, joints and bones of the hand and wrist.

Present day hand, thumb and wrist protectors are bulky, unattractive, inhibit flexibility and movement and are not anatomically contoured to guard against vulnerable sites of injury.

SUMMARY

The glove of the invention supports and stabilizes the wrist and hand during sports and includes:

(a) an inner glove conforming to the hand, fingers and thumb from an area below or proximal to the knuckles including the base of the thumb and extending beyond or distal to the finger and thumb joints;

(b) an outer glove conforming to the hand, fingers and thumb from the wrist to at least beyond or distal to the finger and thumb joints (PIPJ and IPJ);

(c) a first wrist strap surrounding the wrist to protect and support the radiocarpal and distal radioulnar joints and having an opening positioned to accommodate the distal ulna head protrusion; and (d) a second wrist strap protecting against excessive tension, lateral and rotational forces on the wrist attached to the thumb side of the outer glove and extending diagonally across the back of the hand, and then around and encompassing the front and back of the wrist over the first strap.

In a preferred embodiment, the glove of the invention includes criss-cross elastic support members on the exterior of the outer glove overlying the back of the hand from the wrist to an area adjacent or proximal to the knuckles to support and protect the metacarpal bases and the carpal and carpometacarpal joints of the hand and wrist.

BRIEF DESCRIPTION OF THE DRAWINGS

The present invention will be more fully understood from the following description taken in conjunction with the accompanying drawings wherein

FIG. 1(*a*) is a cross-section of the hamate bone from the side showing the hamate hook protrusion;

DESCRIPTION

Figure 1:
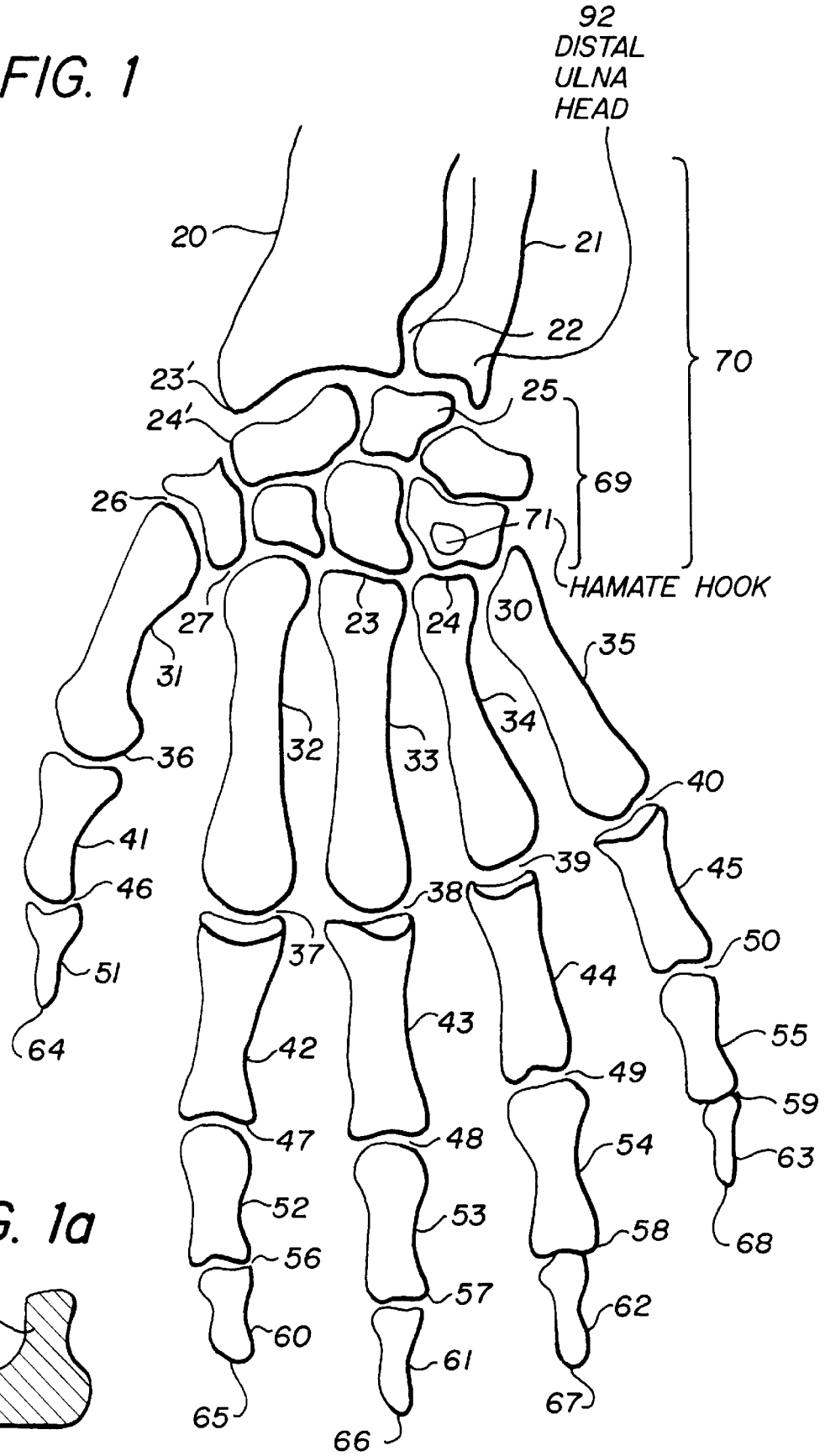
FIG. 1 shows the skeleton of the human hand palm side up.

The invention provides an anatomically contoured sports glove which affords maximum protection to the hands, thumb and wrist yet allows for flexibility, uninhibited grip and aesthetic appeal. The glove provides protection without being bulky or rigid. Materials such as visco-elastic plastics, thermoelastic plastics silicone resins, modified rubber and the like can be used.

For sports such as football, ice and roller hockey, tennis, golf, skiing, baseball and in-line skating, reinforcement is adjusted to protect vulnerable sites of injury. For example, in hockey and football, major reinforcement should be over the top of the knuckles whereas in stick-handling sports such as baseball and golf, the major reinforcement needs to be at the palm and sides of the wrist.

Finger dislocations and fractures, injuries to the ulnar collateral ligament of the thumb and wrist injuries are common in football and hockey as are injuries to the knuckles as a result of hyperextension.

It is important to preserve as much mobility of the wrist as is possible yet provide the maximum protection. It is known that 15–30 degrees of wrist flexion and extension (or up and down motion) is needed to perform most sports and still give participants a feeling of freedom of motion.

For stick-handling sports such as golf, tennis, squash and baseball, the glove of the invention is designed to protect the wrist, thumb and provide palm support with special padding over the hamate hook (the small carpal or wrist bone at the hypothenar eminence, or heel of the palm, the meaty substance at the base of the ring and small (pinky) fingers) and reinforcement at the radial and ulnar aspects of the hand and wrist. In such sports, major ligament injuries (sprains) occur at the wrist such as injury to the distal radioulnar joint which is supported by the triangular fibrocartilage complex (TFCC) complex and the ulnocarpal ligaments. The distal radioulnar joint with the ulna head is the protrusion on the pinky side of the wrist. The hamate hook is often fractured in stick handling sports by impacts or tension forces to the palm. The distal radioulnar joint is frequently injured because of a twisting action in stick-handling sports. The thumb is frequently injured by combined tension and lateral deviation forces.

The most common types of injuries in football include: fractures of phalanges, metacarpals and fracture dislocations of interphalangeal joints (finger fractures and dislocations); digital collateral injuries such as ulnar collateral alignment injury to the thumb; the scaphoid fracture, involving the critical small carpal bone in the wrist; and proximal interphalangeal (PIP) joint dislocations.

The parts of the hand which must be protected in football are the wrist (scaphoid fractures), knuckles, fingers (fractures, dislocations) and thumb (ulnar collateral ligament).

Available football gloves, especially for linesman, commonly have the padding in the wrong place, do not protect vulnerable sites of injury and are not sufficient to protect against injury.

The glove of the invention for football protects against finger and thumb fractures and incorporates flexible shock absorbing means as described in U.S. Pat. No. 5,572,738 which is incorporated herein by reference. The football glove for linesmen and linebackers can be a full glove with fingertips with special protection fashioned about the knuckles. For quarterbacks and other ball handlers, fingertips need not be covered. In any case, the glove should extend two to three inches above or proximal to the distal radioulnar joint (which is the bony protrusion at the side of the wrist). Each finger can be protectively padded in a sausage-like splint. If a player is hurt and returns to play, the glove can be modified with protective padding accentuated for one specific finger.

The crisscross support members serve as protective restraints on the wrist to prevent excessive tension (extension and flexion) and protect against wrist sprains. The criss-cross construction supports the back of the wrist with thickened seams running over the middle of the wrist.

The most common types of injuries in baseball include: hamate hook fractures; collateral ligament injury to the thumb; scaphoid injuries; finger injuries including fractures and dislocations; and distal radioulnar joint sprains.

Current batting gloves do not provide protection for the hamate hook or adequate protection for the wrist. Major protection is provided by the glove of the invention at the wrist, the heel of the palm and at distal radioulnar joints.

The most common types of injuries in skiing include: injuries to the thumb such as ulnar collateral ligament injury to the thumb, commonly called "skier's thumb"; metacarpal fractures and dislocations (finger injuries); scaphoid fractures, and distal radius fractures.

For skiing, the glove of the invention can be part of a ski glove or it can be separately worn inside. Attempts to stabilize and protect the thumb for skiing have led to gloves and devices that are stiff, rigid, unattractive, uncomfortable and bulky. Skiers do not like skiing with such devices. The invention provides the needed protection and support without sacrificing freedom of movement or aesthetics.

Common types of injuries in ice and roller hockey include: scaphoid fractures; carpal bone fractures; distal radius fractures which are especially prevalent; and finger injuries including fractures and dislocations.

The glove for hockey is a modification of the football glove. Padding is reduced so a hockey player can grasp his stick. The glove can be separately inserted into a hockey glove or it can be part of the glove itself. In any case, the hockey glove should extend approximately 2 to 3 inches above or proximal to the distal radioulnar joint. Present day hockey gloves are not long enough and do not adequately protect the wrist which is a highly vulnerable site of injury.

The most common types of injuries in rollerblading or in-line skating include: scaphoid fractures; distal radius fractures; and finger fractures and dislocations.

Hyperextension of the wrist is the primary mechanism of injury in in-line skating. Current wrist guards with rigid plastic or metal inserts actually accentuate hyperextension and afford little cushion against injury. The invention protects the wrist on all planes (top, bottom and sides). For this particular sport, the criss-cross means can be made wide and thick and can extend proximal to or below the metacarpal phalangeal joint (knuckle) area and preferably 2 to 3 inches above or proximal to the wrist.

Thus, the criss-cross means is provided with thickened seams extending over the top of the hand and wrist. Other less bulky seams can extend across the bottom of the wrist and palm to protect against abrasions to the wrist and palm. Also, less bulky seams can protect the sides of the wrist to minimize rotational injuries or excessive forces in a radial or ulnar direction yet permit flexibility of the wrist for in-line skating. The glove must be flexible because participants do not like to wear stiff rigid devices.

The most common types of injuries in Golf include: hamate hook fractures; PIP joint injuries; scaphoid injuries; distal radioulnar joint injuries; and thumb injuries.

The glove of the invention provides protection for the wrist, heel of the palm and the distal radioulnar joint for a glove similar to the glove for baseball and racquet sports.

The most common types of injuries in racquet sports include: hamate hook fractures; PIP joint injuries; scaphoid fractures; distal radioulnar joint injuries; and thumb injuries especially ulnar collateral ligament injuries.

In this embodiment, padding tapers from the palm and becomes thicker as you approach the base of the palm and wrist. This prevents interference with grasping a racquet yet affords adequate wrist protection.

Most racquet players do not wear gloves unless they have been injured. The glove of the invention enhances the grip of the racket and adds protection and can be worn for normal play.

The most common types of injuries in basketball include: finger and finger joint injuries such as dislocations and fractures; and wrist injuries.

Basketball players do not wear gloves. If players are injured, however, the glove of the invention can be used to enhance and expedite a player's return to participation with a higher level of safety without inhibiting performance.

Figure 1A:
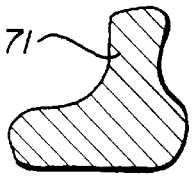

FIG. 1 is a view of the skeleton of the human hand and shows the radius 20, ulna 21, radiocarpal joint (RCJ) 23', distal radio ulnar joint (DRUJ) 22, carpus 69, thumb 64, index finger 65, long finger 66, ring finger 67, and small finger 68. The carpus 69 comprises eight carpal bones, seven of which are shown in FIG. 1 and includes the hamate bone with its hook like protrusion 71 (see FIG. 1*a*), the scaphoid 24' and the lunate 25.

The thumb 64 is comprised of the distal phalanx 51, the interphalangeal joint (IPJ) 46, proximal phalanx 41, metacarpophalangeal joint (MPJ) 36, metacarpal 31, and carpometacarpal joint (CMCJ) 26.

The index finger 65 is comprised of the distal phalanx 60, distal interphalangeal joint (DIPJ) 56, middle phalanx 52, proximal interphalangeal joint (PIPJ) 47, proximal phalanx 42, metacarpophalangeal joint (MPJ) 37, metacarpal 32, and carpometacarpal joint (CMCJ) 27.

The long finger 66 is comprised of the distal phalanx 61, distal interphalangeal joint (DIPJ) 57, middle phalanx 53, proximal interphalangeal joint (PIPJ) 48, proximal phalanxy 43, metacarpophalangeal joint (MPJ) 38, metacarpal 33, and carpometacarpal joint (CMCJ) 23.

The ring finger 67 is comprised of the distal phalanx 62, distal interphalangeal joint (DIPJ) 58, middle phalanx 54, proximal interphalangeal joint (PIPJ) 49, proximal phalanx 44, metacarpophalangeal joint (MPJ) 39, metacarpal 34, and carpometacarpal joint (CMCJ) 24.

The small finger 68 is comprised of the distal phalanx 63, distal interphalangeal joint (DIPJ) 59, middle phalanx 55, proximal interphalangeal joint (PIPJ) 50, proximal phalanx 45, metacarpophalangeal joint (MPJ) 40, metacarpal 35, and carpometacarpal joint (CMCJ) 30.

Figure 2:
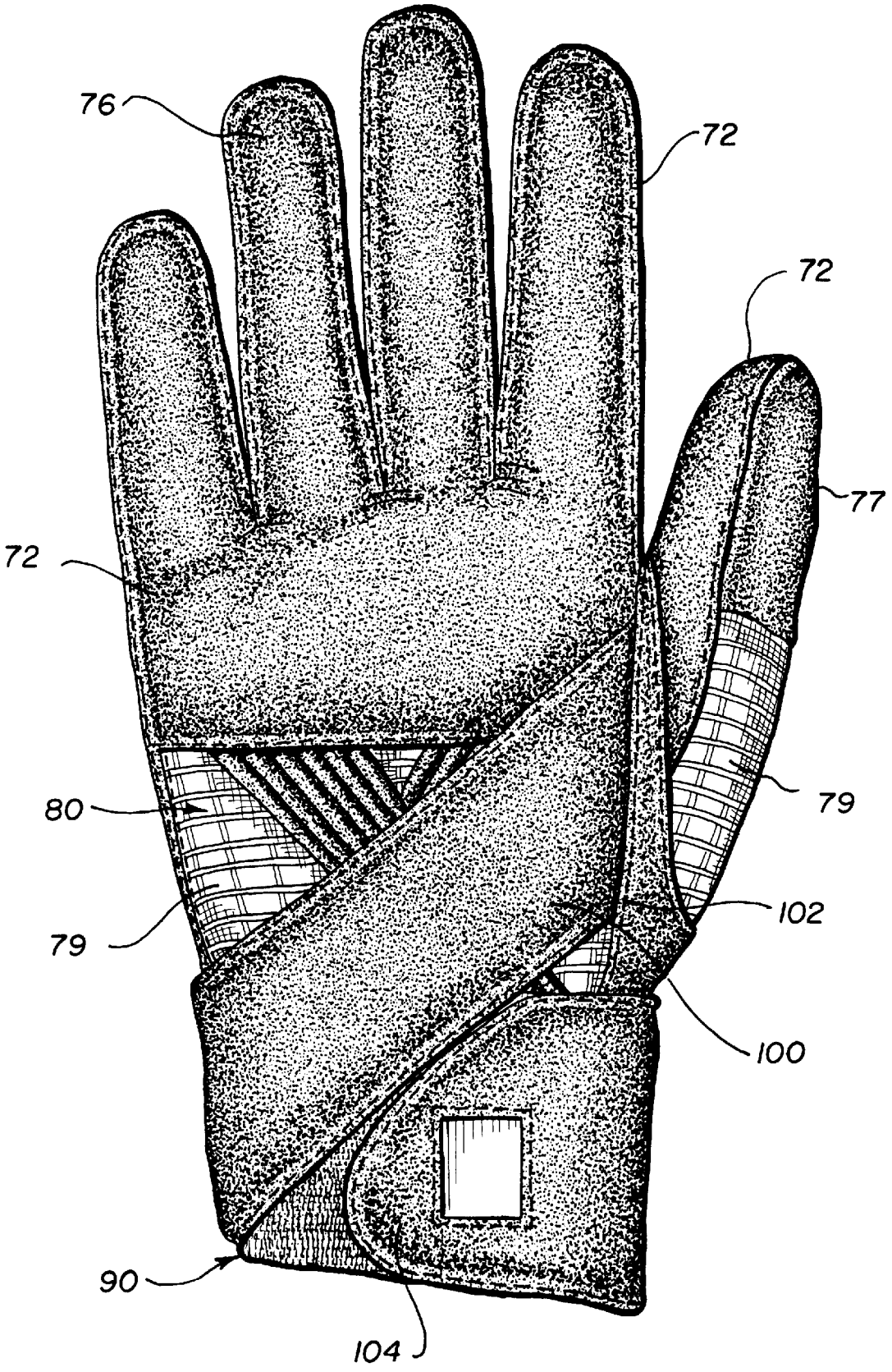
FIG. 2 is a top plan view of a sports glove of the invention from the back or knuckle side of the hand.
Figure 3:
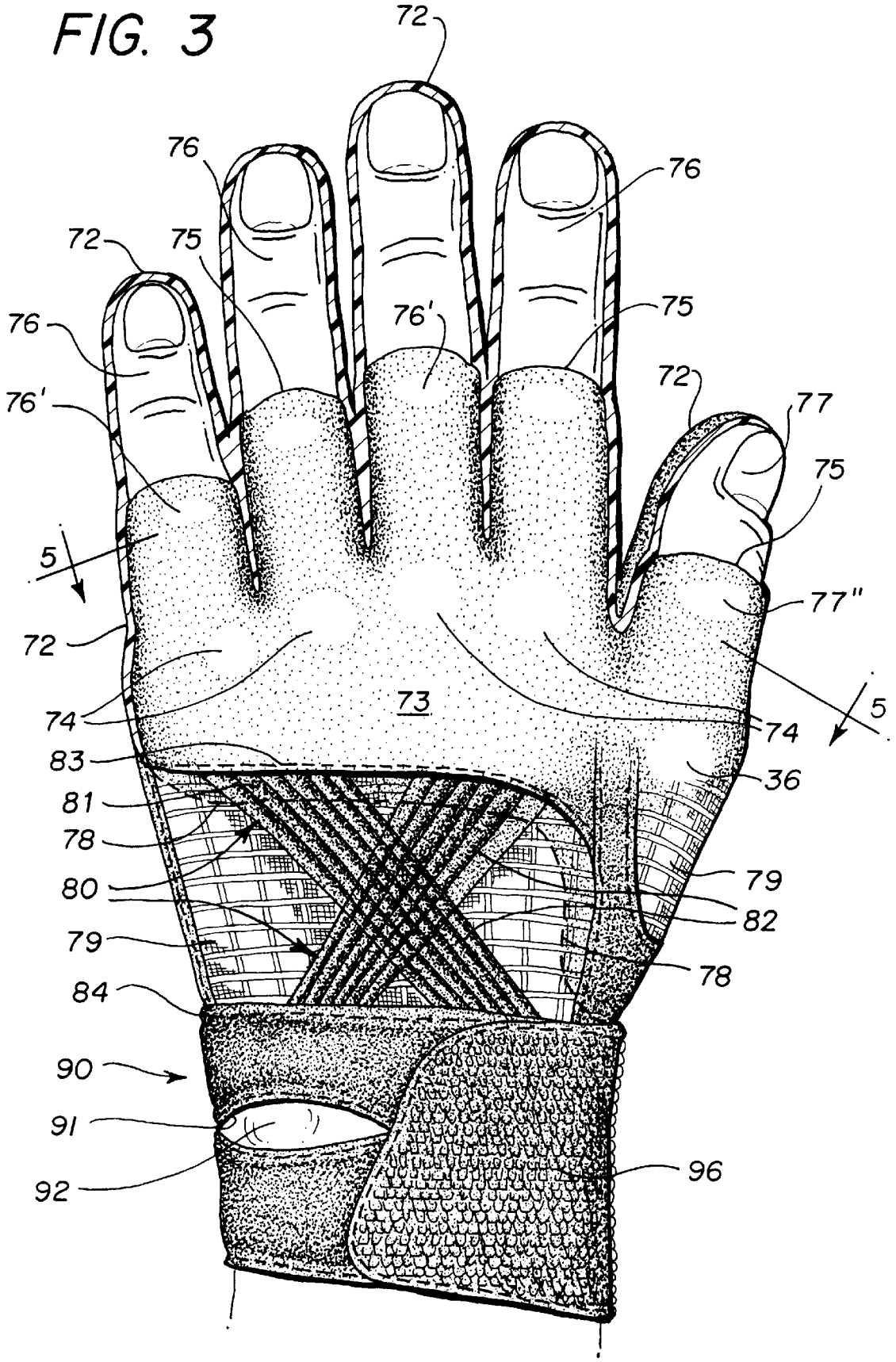
FIG. 3 is the same view as FIG. 2 showing the sports glove of the invention partially in cross-section and without the second wrist strap extending from the thumb side of the sports glove.
Figure 4:
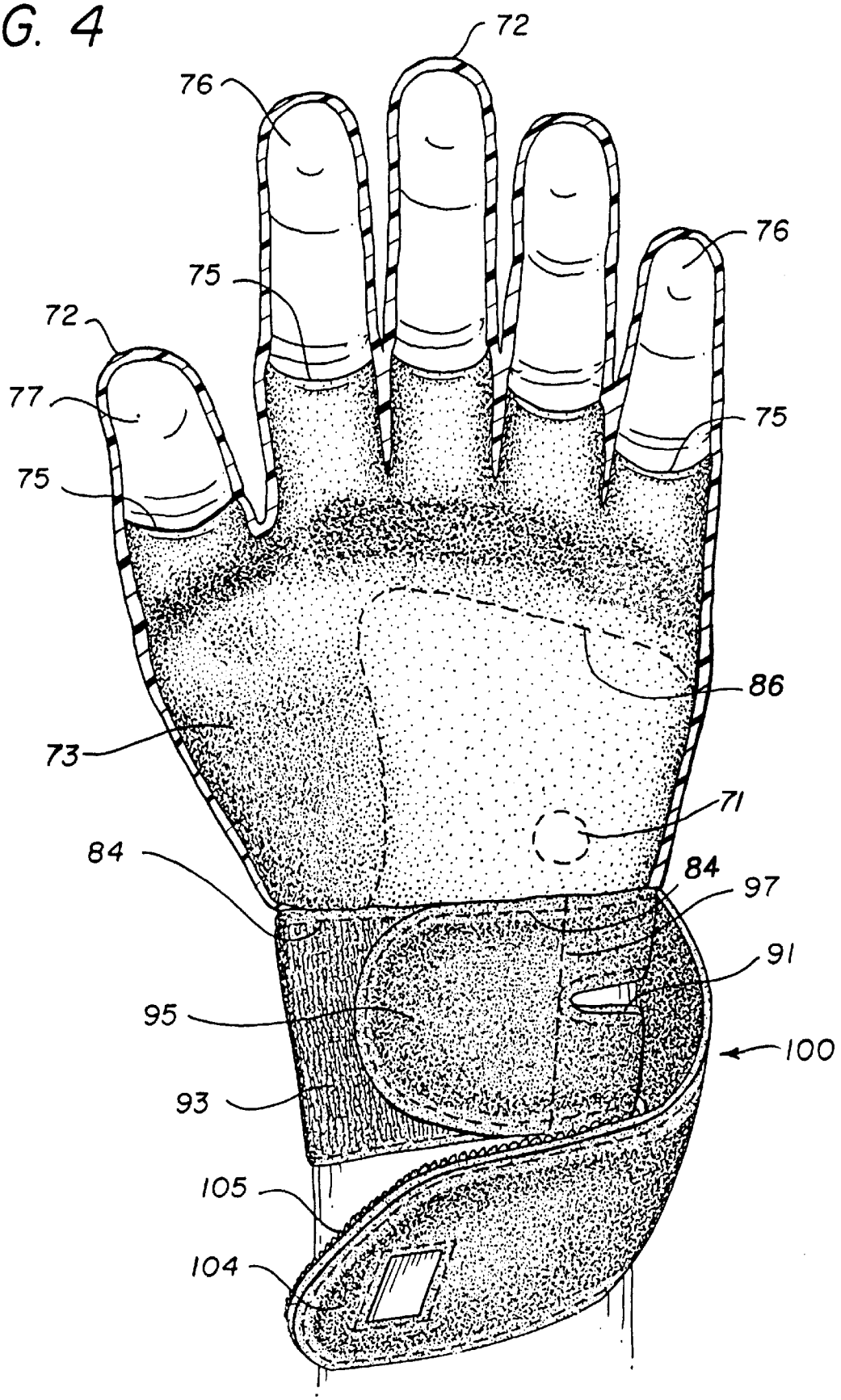
FIG. 4 is a top plan view of the sports glove of the invention from the palm side of the hand and showing the direction of attachment of the second wrist strap attached to the thumb side of the sports glove of the invention.

Referring now to FIGS. 2–4, the sports glove of the invention for stabilizing the wrist and hand during sports is shown to include an inner glove 73 which is preferably made of flexible shock absorbing material to conform to the hand, fingers and thumb of the wearer from an area below or proximal to the knuckles 74 and the base of the thumb 79 delineated generally by dotted line 78 on the back of the hand (FIG. 3) and by dotted line 84 on the palm of the hand (FIG. 4). Glove 73 extends over the knuckles 74 and just beyond the finger PIP joints 76' and thumb IP joint 77" at 75.

On the palm side of the hand (FIG. 4), inner glove 73 surrounds the base of the thumb 79 down to the wrist with additional padding at the heel of the palm to protect the hamate hook 71. For non-stick handling sports like football and boxing, the palm can be open as indicated by dotted line 86. However, thumb protection is retained for all sports.

Inner glove 73 is made of flexible materials like a visco-elastic polymers, silicone resin and the like and can vary in thickness in all areas to provide maximum support, protection and flexibility for individual sports. For example, the area at the base of the finger can be thickened as can the area around the base of the thumb (see FIG. 4).

Outer glove 72 completely envelops the fingers 76 and the thumb 77 as shown in FIG. 2 and is attached to a first strap 90 which surrounds the wrist. In some sports, for better feel, it is desirable to expose the upper portions of the fingers and the thumb.

Criss-cross elastic support members 80 are carried on the exterior of outer glove 72. Criss-cross members 80 are generally made of the same material as glove 72 and contain linear elastic members 81 separated by seams 82. Criss-cross members 80 are stitched into the outer glove 72 extending from lines 83 to 84.

Outer glove 72 and support members 80 can be made of leather, nylon or like glove materials and portion 79 of glove 72 extending from stitch line 83 down to stitch line 84 underneath the criss-cross member 80 and at the base of thumb 77 can be elasticized using a Spandex or like elastic fabric to maintain a flexible, form-fitting glove. The interior of inner glove 73 and those portions of outer glove 72 which come in contact with the skin will normally have a knit liner of nylon or like glove liner materials to facilitate putting the glove on and taking if off.

First wrist strap 90 is attached to outer glove 72 at stitch line 84 and extends from dotted line 97 (FIG. 4) around the back of the wrist and back to the front of the wrist ending up in tab portion 95. Tab 95 is attached to underlying portion 93 by a suitable attachment means such as Velcro hooks and loops as is well known in the art. First wrist strap 90 is provided with opening 91 to accommodate the distal ulna protrusion 92 and the strap 90 itself surrounds the wrist as shown in FIG. 3 to protect and support the distal radioulnar joint on the outer wrist.

To provide maximum protection and support and limit excessive lateral movement of the wrist, the portion 93 of strap 90 is wider at the thumb side of the hand as compared to the width of the strap containing the ulna opening 91 on the other side of the wrist.

First strap 90 also includes an area generally indicated by reference numeral 96 to which is attached Velcro loops or hooks for securing the second wrist strap 100 as described below.

As shown in FIG. 2, a second wrist strap 100 is attached along stitch line 102 adjacent to the thumb and extends therefrom diagonally across the back of outer glove 72, over the criss-cross members 80, around the wrist and over the first wrist strap means 90 as shown in FIGS. 2 and 4. Strap 100 is held in place at its end 104 via Velcro hooks or loops 105 which mate with Velcro loops or hooks 96 on the exterior of first strap 90 at the top of the wrist. Second wrist strap 100 affords protection against excessive tension, lateral and rotational forces on the wrist.

Figure 5:
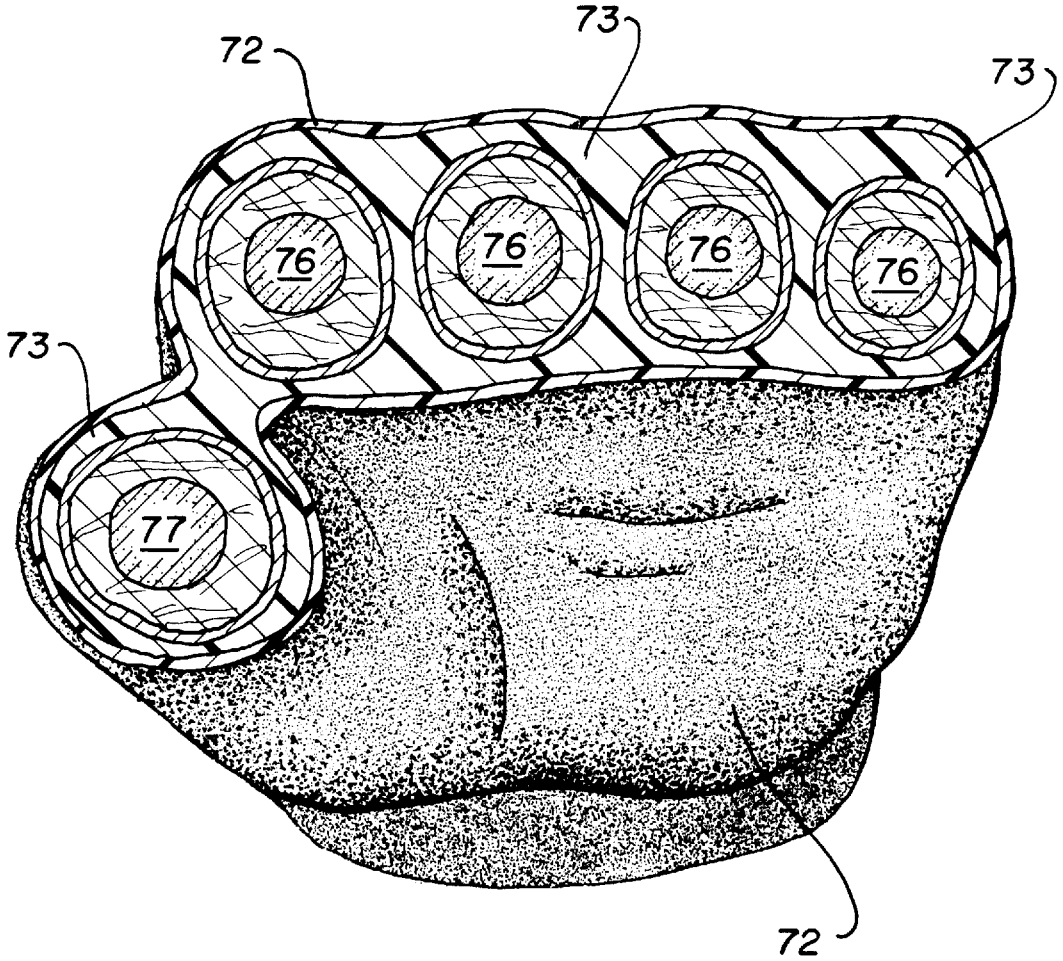
FIG. 5 is a cross sectional view of FIG. 3 taken along line 5—5.

FIG. 5, shows in cross-section at line 5—5 of FIG. 3 how inner glove 73 protects and supports the fingers and thumb Straps 90 and 100 can be made of the same material as outer glove 72 and can be thickened to enhance wrist support and protection by adding layers and stitching as required for individual sports.

What is claimed is:

1. Glove for supporting and stabilizing the wrist and hand during sports comprising;

(a) inner glove means conforming to the hand, fingers and thumb from an area proximal to the knuckles including the base of the thumb and extending distal to the finger and thumb metacarpophalangeal joints;

(b) outer glove means conforming to the hand, fingers and thumb extending from the wrist to at least beyond the finger and thumb joints;

(c) criss-cross elastic support means on the exterior of the outer glove means overlying the back of the hand from the wrist to an area adjacent to the knuckles to support and protect the metacarpal bases and the carpometacarpal joints of the hand and wrist;

(d) first wrist strap means surrounding the wrist to protect and support the radiocarpal and distal radioulnar joints and having an opening positioned to accommodate the distal ulna protrusion; and (e) second wrist strap means protecting against excessive tension, lateral deviation and rotational forces on the wrist attached to the thumb side of the outer glove and extending diagonally across the back of the hand and around the wrist over the first wrist strap means.

2. Glove of claim 1 wherein the inner glove means comprises flexible shock absorbing means.

3. Glove of claim 1 wherein the inner glove means protects the hamate hook.

4. Glove of claim 1 wherein the first strap means is wider on the thumb side of the hand to enhance protection of vulnerable carpal bones and distal radius and to limit excessive lateral motion.

5. Glove of claim 1 wherein the first and second strap means are adjustable in size and are held in place by hook and loop fastener means.

6. Glove of claim 1 wherein the outer glove means envelopes all of the fingers and thumb.

7. Glove for supporting and stabilizing the wrist and hand during sports comprising:

(a) inner glove means conforming to the hand, fingers and thumb from an area proximal to the knuckles including the base of the thumb and extending distal to the finger and thumb joints;

(b) outer glove means conforming to the hand, fingers and thumb extending from the wrist to at least beyond the finger and thumb joints;

(c) first wrist strap means surrounding the wrist to protect and support the radiocarpal and distal radioulnar joints and having an opening positioned to accommodate the distal ulna protrusion; and (d) second wrist strap means protecting against excessive tension, lateral and rotational forces on the wrist attached to the thumb side of the outer glove means and extending diagonally across the back of the hand and around the wrist over the first wrist strap means.

8. Glove of claim 7 wherein the inner glove means comprises flexible shock absorbing means.

9. Glove of claim 7 where the inner glove means protects the hamate hook.

10. Glove of claim 7 wherein the first strap means is wider on the thumb side of the hand to enhance protection of vulnerable carpal bones and distal radius and to limit excessive lateral motion.

11. Glove of claim 7 wherein the first and second strap means are adjustable in size and are held in place by hook and loop fastener means.

12. Glove of claim 7 wherein the outer glove means envelopes all of the fingers and thumb.

13. Glove for supporting and stabilizing the wrist and hand during sports comprising:

(a) inner glove means conforming to the hand, fingers and thumb from an area proximal to the knuckles including the base of the thumb and extending distal to the finger and thumb joints;

(b) outer glove means conforming to the hand, fingers and thumb extending from the wrist to at least beyond or distal to the finger and thumb joints;

(c) crisscross elastic support means on the exterior of the outer glove means overlying the back of the hand from the wrist to an area adjacent to the knuckles to support and protect the metacarpal bases and the carpal and carpometacal joints of the hand and wrist.

14. Glove of claim 13 wherein the outer glove means comprise flexible shock absorbing means.

15. Glove for supporting and stabilizing the wrist and hand during sports comprising:

(a) inner glove means conforming to the hand, fingers and thumb from an area proximal to the knuckles including the base of the thumb and extending distal to the finger and thumb joints;

(b) outer glove means conforming to the hand, fingers and thumb extending from the wrist to at least beyond or distal to the finger and thumb joints;

(c) wrist strap means surrounding the wrist to protect and support the radiocarpal and distal radioulnar joints and having an opening positioned to accommodate the distal ulna protrusion.

16. Glove of claim 15 wherein the inner glove means comprises flexible shock absorbing means.

17. Glove for supporting and stabilizing the wrist and hand during sports comprising:

(a) inner glove means conforming to the hand, fingers and thumb from an area proximal to the knuckles including the base of the thumb and extending distal to the finger and thumb joints;

(b) outer glove means conforming to the hand, fingers and thumb extending from the wrist to at least beyond or distal to the finger and thumb joints;

(c) criss-cross elastic support means on the exterior of the outer glove means overlying the back of the hand from the wrist to an area adjacent to the knuckles to support and protect the metacarpal bases and the carpal and carpometacarpal joints of the hand and wrist;

(d) wrist strap means surrounding the wrist to protect and support the radiocarpal and distal radioulnar joints and having an opening positioned to accommodate the ulna protrusion.

* * * * *

UNITED STATES PATENT AND TRADEMARK OFFICE

CERTIFICATE OF CORRECTION

PATENT NO. : 5,802,614
DATED : September 8, 1998
INVENTOR(S) : Charles P. Melone, Jr.

It is certified that error appears in the above-identified patent and that said Letters Patent is hereby corrected as shown below:

Title page,
References Cited, change "12/1951" to -- 12/1946 --.

Signed and Sealed this

Fifth Day of February, 2002

*Attest:*

*Attesting Officer*

JAMES E. ROGAN
*Director of the United States Patent and Trademark Office*